US010134501B2

(12) United States Patent
Hunter et al.

(10) Patent No.: US 10,134,501 B2
(45) Date of Patent: Nov. 20, 2018

(54) INTERCONNECTION BETWEEN CONDUCTING POLYMER MATERIALS

(71) Applicant: Massachusetts Institute of Technology, Cambridge, MA (US)

(72) Inventors: Ian W. Hunter, Lincoln, MA (US); Lauren Montemayor, San Antonio, TX (US); Eli Travis Paster, Cambridge, MA (US); Priam Pillai, Pleasant Hill, CA (US)

(73) Assignee: Massachusetts Institute of Technology, Cambridge, MA (US)

( * ) Notice: Subject to any disclaimer, the term of this patent is extended or adjusted under 35 U.S.C. 154(b) by 218 days.

(21) Appl. No.: 13/766,257

(22) Filed: Feb. 13, 2013

(65) Prior Publication Data

US 2013/0197162 A1 Aug. 1, 2013

Related U.S. Application Data

(63) Continuation of application No. PCT/US2011/045747, filed on Jul. 28, 2011.

(60) Provisional application No. 61/373,298, filed on Aug. 13, 2010.

(51) Int. Cl.
*H01B 1/12* (2006.01)

(52) U.S. Cl.
CPC ..... *H01B 1/127* (2013.01); *H01B 1/12* (2013.01)

(58) Field of Classification Search
CPC ..... H01B 1/127; H01B 1/12
See application file for complete search history.

(56) References Cited

U.S. PATENT DOCUMENTS 3,723,590 A * 3/1973 Anderson ..... H01C 1/148 164/108
4,069,083 A * 1/1978 Palmer ..... 156/329
4,273,728 A * 6/1981 Krespan ..... C07C 43/225 526/244
4,711,742 A * 12/1987 Jen et al. ..... 252/500
5,093,033 A * 3/1992 Feldhues et al. ..... 252/500
5,324,453 A * 6/1994 Cao ..... H01B 1/128 252/500
6,117,554 A * 9/2000 Shalaby et al. ..... 428/420
2001/0003773 A1* 6/2001 Schmid ..... H01B 1/02 528/9
2005/0159580 A1 7/2005 Liu et al.
2006/0131567 A1 6/2006 Liu et al.
2008/0067475 A1* 3/2008 McCulloch ..... H01L 51/0005 252/500
2009/0286097 A1* 11/2009 Yang et al. ..... 428/500

FOREIGN PATENT DOCUMENTS

WO 2007005617 A2 1/2007

OTHER PUBLICATIONS

J. Ouyang et al., "Conducting Polymer as Transparent Electric Glue" Advanced Materials, vol. 18, No. 16, Aug. 18, 2006, pp. 2141-2144.
International Search Report and Written Opinion issued in connection with corresponding PCT Application No. PCT/US2011/045747, issued on Dec. 19, 2011.
International Preliminary Report on Patentability mailed on Feb. 28, 2013 in connection with International Patent Application No. PCT/US2011/045747 filed on Jul. 28, 2011, 5 pages.

* cited by examiner

*Primary Examiner* — Irina Krylova
(74) *Attorney, Agent, or Firm* — Gesmer Updegrove LLP

(57) ABSTRACT

Method for connecting two portions of a first electrically conducting polymer with a second polymer. The method includes disposing a solution of a second polymer in a solvent to be in contact with the two portions of the first electrically conducting polymer and allowing the solvent to evaporate leaving the second polymer joining the two portions of the first polymer. The second polymer may be doped to improve its conductivity.

2 Claims, 2 Drawing Sheets

INTERCONNECTION BETWEEN CONDUCTING POLYMER MATERIALS

PRIORITY INFORMATION

The present application is a continuation of PCT Application No. PCT/US2011/045747, filed on Jul. 28, 2011 and claims priority to U.S. Provisional Application Ser. No. 61/373,298 filed on Aug. 13, 2010 both of which are incorporated herein by reference in their entireties.

SPONSORSHIP INFORMATION

This invention was made with government support under Contract No. D11PC75421 awarded by the Department of Interior. The government has certain rights in the invention.

BACKGROUND OF THE INVENTION

This invention relates to electrically conducting polymers and more particularly to a method for joining portions of electrically conducting polymers.

Conducting polymers such as polypyrrole (PPy) have many uses resulting primarily from the fact that the polymers are flexible and can be made into thin films among other geometries. Those with skill in the art will recognize that flexible electrically conducting polymers can be used as substitutes for metal conductors. In many applications, it may be required to join two portions of a conductive polymer together and assure that the joined material is itself electrically conducting. Many interconnect techniques involve using metal solder which can add weight and impede the flexibility of the polymer material. Other techniques involve high temperatures or large electrical potentials that degrade the electrical and mechanical properties of the polymer.

An object of the invention is to provide a method that is simple and flexible method of joining conductive polymers.

SUMMARY OF THE INVENTION

The method involves connecting two portions of an electrically conducting polymer using a second soluble polymer. It includes disposing a solution of the soluble polymer in contact with the two portions of the first electrically conducting polymer. The solvent is allowed to evaporate leaving the second polymer joining the two portions of the first polymer. In a preferred embodiment, the first electrically conducting polymer is polypyrrole (PPy). A suitable second polymer for this application is poly 3-hexyl thiophene (P3HT). A suitable solvent for the P3HT is dichloromethane which wets the surface of the PPy. In a preferred embodiment, the solution is 0.3 wt % poly 3-hexyl thiophene in dichloromethane. The P3HT is doped with iodine to improve its conductivity.

DESCRIPTION OF THE PREFERRED EMBODIMENT

Figure 1A:
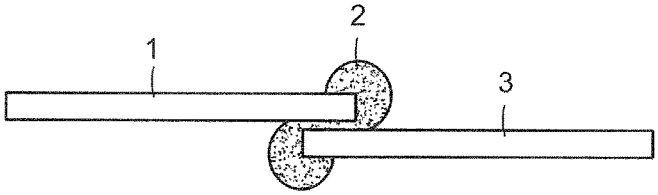
FIG. 1*a* is a schematic illustration showing the joining of two portions of a conducting polymer connected using a soluble conducting polymer interconnect.

With reference first to FIG. 1*a*, polypyrrole portions 1 and 3 have been joined with another conducting polymer, poly 3-hexyl thiophene (P3HT). This is designated as element 2.

Figure 1B:
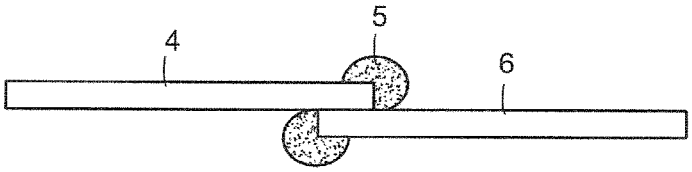
FIG. 1*b* is a schematic illustration showing the joining of two portions of conducting polymer using a soluble non-conducting polymer interconnect.
Figure 2:
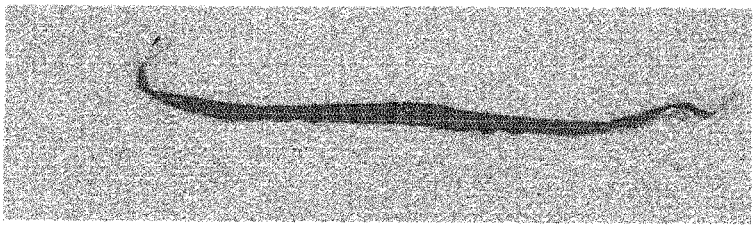
FIG. 2 is a photograph of polymer joined by the method of the invention.
Figure 4A:
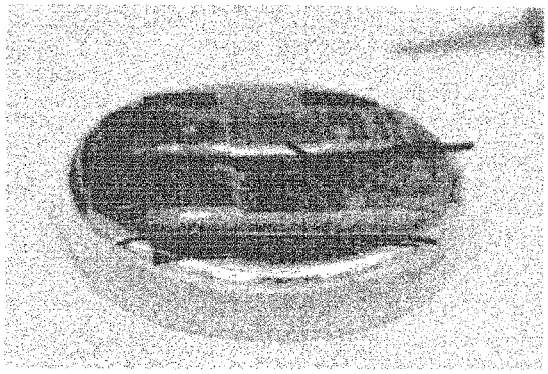
FIG. 4*a* is a picture of the joining procedure showing the unconnected conducting polymer strips
Figure 4B:
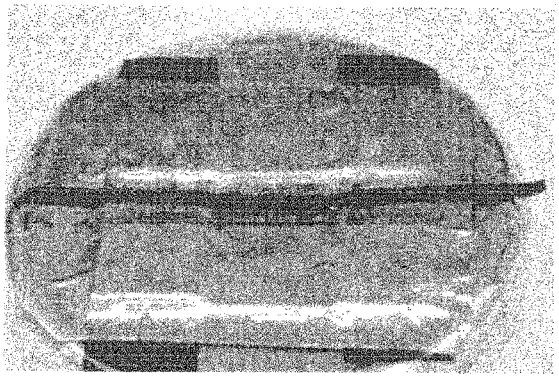
FIG. 4*b* is a picture of the joining procedure showing the two strips immersed into the solution

In an experiment, two thin strips of polypyrrole having dimensions 3 mm by 20 μm by 50 mm and 3 mm by 20 μm by 45 mm were fixed on the sides of a platform of a Teflon coated well. A solution of 0.3 wt % poly 3-hexyl thiophene (4.5 mg/ml) in dichloromethane (DCM) was drop cast into the well. As the DCM evaporated, a P3HT film comes out of solution in the interface between the PPy strips 1 and 3. The P3HT film creates a conducting polymer bond that joins the two strips 1 and 3 together (This procedure is illustrated in FIGS. 4*a* and 4*b*). While P3HT is electrically conducting, it is not as conducting as PPy so its conductivity can be improved by doping the P3HT film with iodine. The doping was performed by leaving iodine crystals with the joined film under a vacuum. The joined film is illustrated in the photograph of FIG. 2. FIG. 1*b* also shows another embodiment of the invention were a soluble non-electrically conducting polymer can be used to create the interconnect. In this embodiment a soluble polymer forms around the joint encasing the junction.

The electrical resistance of the PPy strips 1 and 3 joined with the P3HT was measured before and after the iodine doping step. The results are shown in the Table below.

TABLE

| | Pure P3HT (Ω) | $I_2$ Doped (Ω) |
|---|---|---|
| Left Strip | 230 | 21 |
| Right Strip | 30 | 24 |
| Total Strip | 3370 | 50 |

Figure 3:
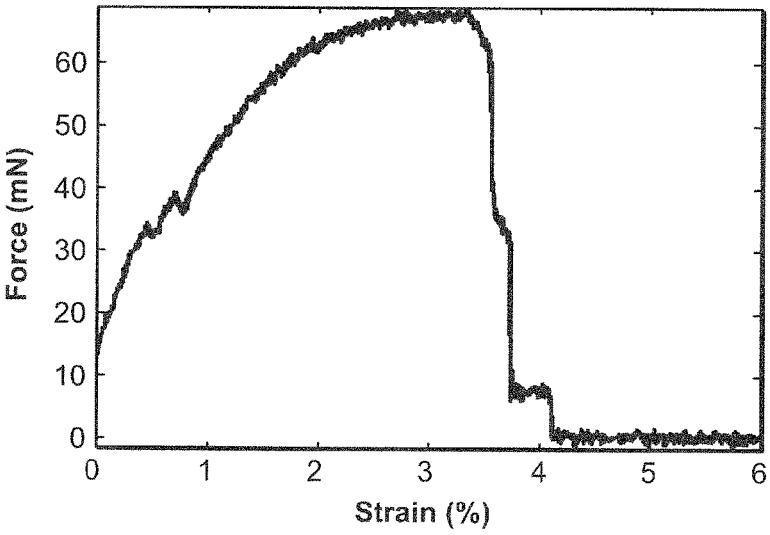
FIG. 3 is a graph of a uniaxial tensile test for the joined polymer.
Figure 5:
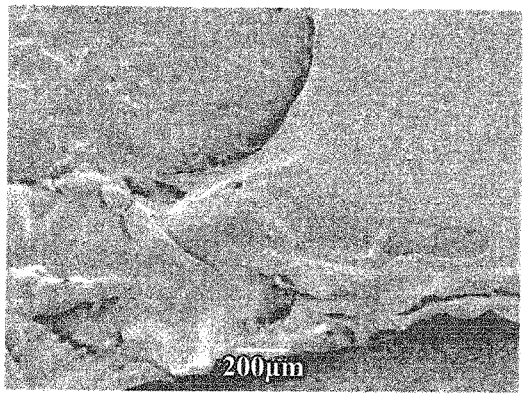
FIG. 5 is an SEM image of a fractured PPy film at the joint with P3HT.

Stress-strain curves were measured of the joined strips and the film fractured at the P3HT joint. FIG. 3 shows the force strain curve. FIG. 5 is a scanning electron microscope micrograph showing the fracture at the joint with the P3HT. Those of ordinary skill in the art will recognize that different geometries of the conducting polymers may be used such as wires, strips or two dimensional films. Conducting polymers in all of these geometrics can be joined by the method disclosed herein. While this disclosure has focused on PPy joined with P3HT, it is to be understood that the method of the invention can be used with any conductive polymers. For example any conducting polymer including but not limited to polypyrrole, poly 3-hexyl thiophione, poly aniline, poly 3-ethylene dioxythiophnes etc can be joined using this method. Any soluble polymer including but not limited to poly 3-hexyl thiophene, polyaniline or polystyrene can also be used the interconnect material.

It is recognized that modifications and variations of the invention will be apparent to those of ordinary skill in the art and all such modifications and variations are included within the scope of the appended claims.

What is claimed is:

1. A method for connecting two separate portions of an electrically conducting polymer comprising:

disposing a solution of a soluble polymer in a solvent such that it is in contact with the two separate portions of an electrically conducting polypyrrole, the solution being 0.3 wt % poly 3-hexyl thiophene in dichloromethane;

allowing the solvent to evaporate leaving a film of the soluble polymer joining the two separate portions of the electrically conducting polymer, the thin film of the soluble polymer is poly 3-hexyl thiophene; and doping the layer of the soluble polymer to improve its electrical conductivity, wherein the electrically conducting polymer consisting of polypyrrole.

2. The method of claim 1, wherein the soluble polymer is doped with iodine to improve its conductivity.

* * * * *